United States Patent [19]

Kitchen

[11] Patent Number: 4,697,358

[45] Date of Patent: Oct. 6, 1987

[54] PULSE COMBUSTION APPARATUS

[75] Inventor: John A. Kitchen, Hastings, Canada

[73] Assignee: John A. Kitchen Ltd., Hastings, Canada

[21] Appl. No.: 905,222

[22] Filed: Sep. 9, 1986

[51] Int. Cl.[4] ..... F26B 23/02

[52] U.S. Cl. ..... 34/191; 34/218; 431/1; 432/159; 432/186

[58] Field of Search ..... 431/1, 157, 158; 126/110; 34/191, 218; 432/159, 186

[56] References Cited

U.S. PATENT DOCUMENTS 2,898,978 8/1959 Kitchen ..... 431/1

*Primary Examiner*—Larry I. Schwartz

*Attorney, Agent, or Firm*—Rogers, Bereskin & Parr

[57] ABSTRACT

Various improvements in pulsating combustors for use in dehydration are disclosed. In one aspect of the invention, gas is introduced into the combustion chamber through a fuel distributor providing a bluff body within the combustion chamber so that a striated charge having streaks of gas and air is produced. The tail pipe of the combustor has an enlarged outer portion provided with an inlet for material to be dehydrated so that an injector action occurs at the point of material entry. A valve may be associated with the material inlet so that the material is introduced in timed relation to the pulse combustion cycle. Other aspects of the invention concern a rotary mechanically driven air admitting valve for the combustion chamber and a gas supply arrangement designed to provide for low- and high-fire operating modes.

22 Claims, 10 Drawing Figures

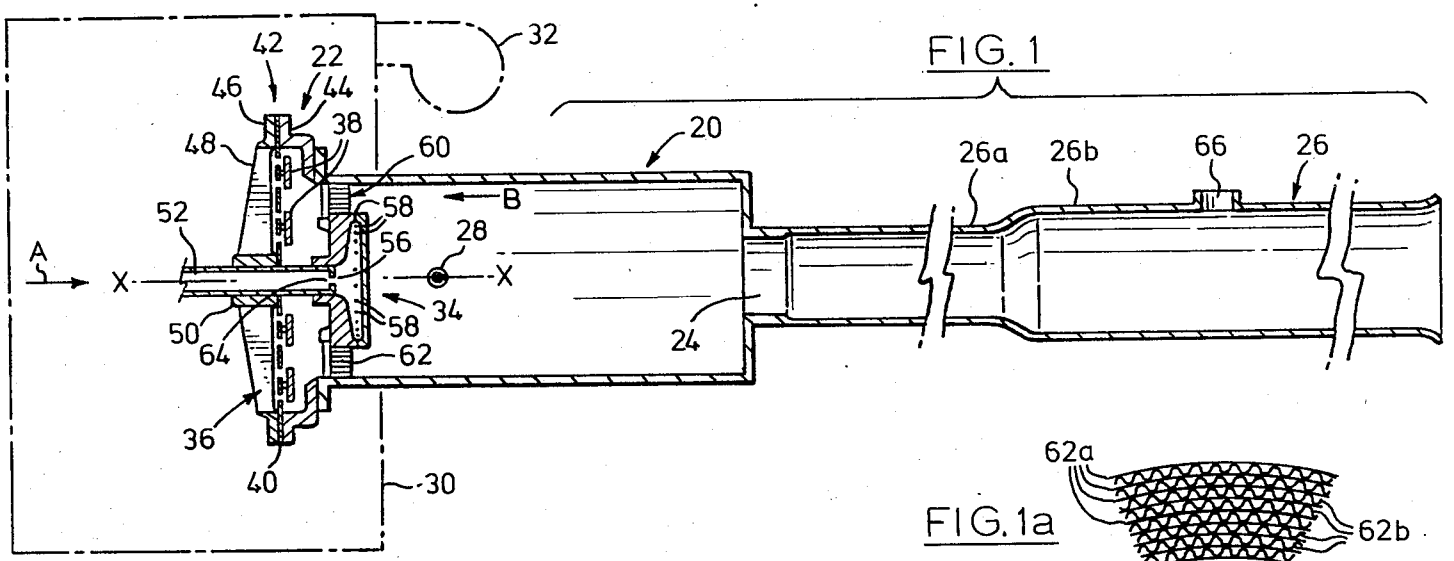
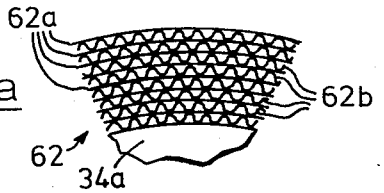
FIG. 1a
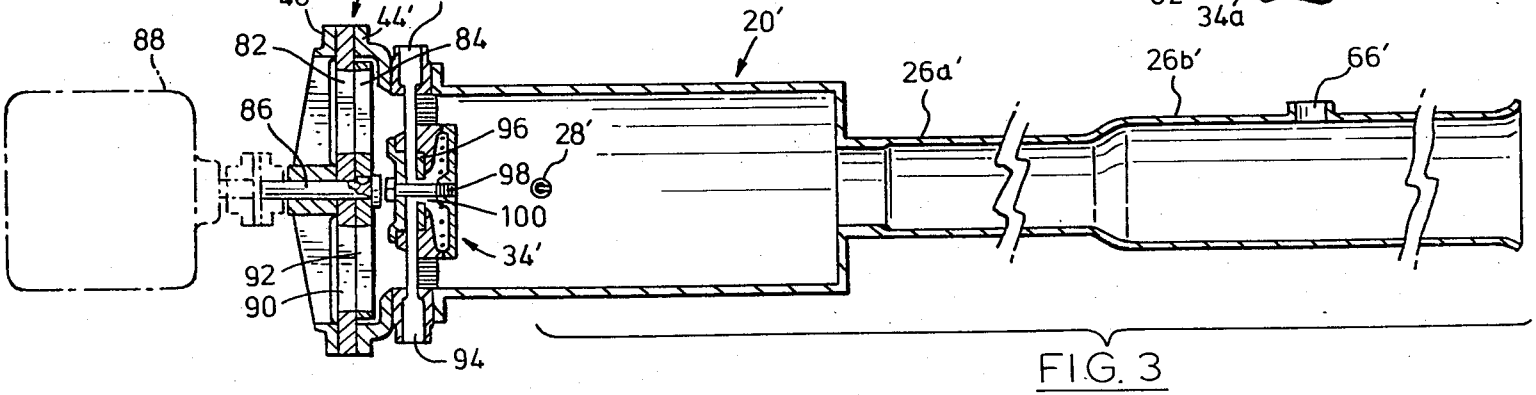

PULSE COMBUSTION APPARATUS

FIELD OF THE INVENTION

The invention relates generally to pulse combustion apparatus.

BACKGROUND OF THE INVENTION

Typically, a pulse combustion apparatus includes a combustion chamber and an exhaust pipe (often called a "tail pipe") which forms a resonant system with the combustion chamber. The apparatus operates on a cycle in which a fuel charge is admitted to the combustion chamber and ignited. The charge then expands into the exhaust pipe causing a partial vacuum in the combustion chamber, which both assists in drawing in a fresh fuel charge and causes high temperature gas to be drawn back into the combustion chamber from the exhaust pipe. The fresh fuel charge ignites spontaneously thereby establishing the next cycle. Accordingly, operation of the apparatus is selfsustaining after initial ignition. The term "pulse combustor" is often used synonymously with "pulse combustion apparatus".

DESCRIPTION OF THE PRIOR ART

Examples of practical applications of this type of pulse combustion apparatus are in dehydration and for heat and power generation. Pulse combustion apparatus used primarily for heating water are shown in my U.S. Pat. Nos. 3,267,985; 4,241,720 and 4,241,723. Examples of pulse combustion apparatus used for heating air are shown in my U.S. Pat. Nos. 2,916,032 and 4,309,977. Other examples are Huber et al. (U.S. Pat. No. 2,708,926), Hollowell (U.S. Pat. No. 4,164,210), Salgo U.S. Pat. No. 3,005,485) and my U.S. Pat. No. 2,898,978.

Reference is also made to U.S. Pat. No. 2,515,644 (Goddard) and U.S. Pat. No. 3,332,236 (Kunsagi) in connection with the use of rotary mechanically driven valves in pulse combustors.

Examples of the use of pulse combustors in dehydration are to be found in U.S. Pat. Nos. 3,462,955 and 3,618,655 (both to Lockwood). The latter patent discloses the use of a pulse combustor in combination with a "cyclone" type of separator for recovering dehydrated material.

In practice, certain hazards are associated with large scale pulse combustors that are fired into closed chambers such as cyclone separators and boilers. It is important that these combustors be capable of starting reliably and that accumulation of combustible gas within the combustor be avoided, otherwise a dangerous explosion could occur.

A practical difficulty encountered in using a pulse combustor as in dehydrator is that a positive pressure may occur in the exhaust pipe or tail pipe of the combustor due to back pressure on the combustion chamber from the cyclone separator or collection chamber. This makes it difficult to feed some materials into the tail pipe.

A further difficulty encountered in using conventional pulse combustors for dehydration is that it may be necessary to operate the combustor at higher than normal operating temperatures and pressures, particularly where preheating of the combustion of the combustion air is employed. These operating conditions may have a deleterious effect on the diaphragm type valves that are often used in pulse combustors.

With this background, the object of the present invention is to provide a number of improvements relating to pulse combustion apparatus primarily (but not exclusively) for use in dehydration.

SUMMARY OF THE INVENTION

The invention is concerned generally with a pulse combustion apparatus including a combustion chamber having inlet means for fuel charges and an outlet for gases remote from the inlet means, an exhaust pipe extending from the exhaust gas outlet and forming a resonant system with the combustion chamber, and means operable to initiate combustion in said chamber.

In one aspect of the invention, the fuel charge inlet means takes the form of a fuel gas distributor forming a bluff body within the combustion chamber and defining an annular combustion air passageway around the body, the distributor having a fuel inlet for connection to a fuel supply externally of the combustion chamber, and a plurality of outlets extending around a peripheral surface of the bluff body. Valve means is also provided for admitting air to the air passageway during low pressure portions of the pulse combustion cycle. Accordingly, at each cycle, a striated charge having streaks of gas and air is introduced into the combustion chamber.

Evidence has shown that, particularly with large combustors, a striated charge performs better than a thoroughly mixed charge. Specifically, it is believed that improved starting and a stronger cycle may be achieved, as compared with conventional fuel charge inlet arrangements. As explained previously, reliable starting is particularly important for large scale combustors that are fired into closed chambers.

In another aspect of the invention specifically applicable to dehydration, the exhaust pipe of the apparatus includes an inner portion adjacent the combustion chamber of a first diameter and an outer portion adjacent the inner portion, of increased diameter. The exhaust pipe is provided with a material inlet arranged in the outer portion so that gases flowing from the inner portion to the outer portion cause an injector action at the material inlet.

It has been found that this aspect of the invention faciliate feeding of material into the exhaust pipe of the combustor by providing a negative pressure at the material inlet. This avoids the problem discussed previously in which feeding of particulate material into the exhaust pipe is, at least to some extent, obstructed by positive pressure occurring in the exhaust pipe at the point of material infeed.

According to a further aspect of the invention, a rotary air admitting valve is used as part of the fuel charge inlet means for controlling communication between the combustion chamber and a combustion air supply. The valve is made up of first and second plates mounted in fact-to-face contact with the first plate fixed and the second rotatable with respect to the first. The plates are formed with matching openings for controlling communication between the combustion air supply and the combustion air chamber, and drive means is provided for rotating the second plate at a speed appropriate to the pulsating combustion cycle of the apparatus.

A valve of this form may be better able than conventional diaphragm valves to withstand the high operating temperatures and pressures that may be encountered in some forms of pulsating combustor.

According to a still further aspect of the invention, a pulse combustion apparatus of the general form referred to above may include fuel supply means connected to the combustion chamber inlet means and including means operable to restrict fuel flow to the inlet means for providing a low fire operating mode for starting of the apparatus and a high fire normal operating mode.

This capability for providing a low fire operating mode is particularly advantageous for starting purposes. Coupled with suitable purge periods this capability can reduce the risk of combustible gas accumulating and possibly causing a dangerous explosion.

Alternatively, the fuel supply means may include means operable to modulate fuel flow to the inlet means of the combustion chamber according to load conditions.

A further aspect of the invention relates specifically to dehydration and provides a pulse combustor dehydration apparatus that the includes a series of at least two pulse combustors each having a combustion chamber with inlet means for fuel charges and an outlet for gases remote from the inlet means, an exhaust pipe extending from the exhaust gas outlet and forming a resonant system with the combustion chamber, the exhaust pipe including an inlet for material to be dehydrated, and means operable to initiate combustion in said chamber. Associated with each combustor is material collection means having an inlet receiving said exhaust pipe, a gas outlet and an outlet for said material. The combustors are disposed in a cascade arrangement with the outlet of the material collection chamber of a first one of said combustors communicating wih the material inlet of the exhaust pipe of a second said combustor so that the material is subjected to successive dehydration processing in each of said combustors.

BRIEF DESCRIPTION OF THE DRAWINGS

In order that the invention may be more clearly understood, reference will now be made to the accompanying drawings which illustrate preferred embodiments of the invention by way of example, and in which:

FIG. 1 is a longitudinal sectional view through a pulse combustion apparatus in accordance with a first embodiment of the invention;

FIG. 1*a* is a detail view in the direction of arrow B in FIG. 1;

FIG. 3 is a view similar to FIG. 1 showing a second embodiment;

DESCRIPTION OF THE PREFERRED EMBODIMENTS

Figure 4:
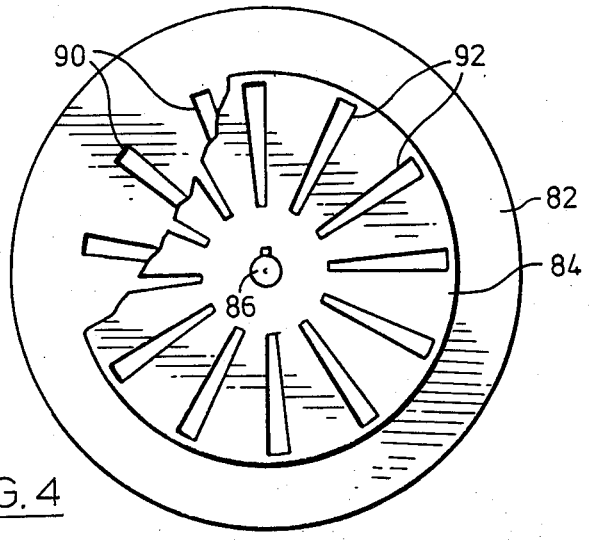
FIG. 4 is an enlarged view of part of the apparatus of FIG. 2.

Referring first to FIG. 1, a pulse combustion apparatus is shown to comprise a cylindrical combustion chamber 20 having at one end fuel charge inlet means generally indicated at 22 and, at the other end, an outlet 24 for exhaust gases. An exhaust pipe 26 extends from the exhaust gas outlet 24 and forms a resonant system with the combustion chamber. A spark plug 28 is shown in the combustion chamber for initiating combustion. Suitable electrical equipment (not shown) is provided for generating a spark at plug 28 as is well known in the art. Once initiated, combustion is of course self-sustaining and the spark plug is no longer needed.

It is also conventional in the art to use a blower to deliver combustion air to the combustion chamber under pressure for starting. Typically, an enclosure such as that indicated in ghost outline in FIG. 1 at 30 surrounds the fuel charge inlet means 22. A blower 32 is shown coupled for delivering air into the enclosure.

The fuel charge inlet means 22 includes a fuel gas distributor generally denoted 34 and valve means generally indicated at 36 for admitting air for enclosure 30. In this particular embodiment, the valve means take the form of a series of pressure-responsive one-way diaphragm valves indicated at 38, co-operating with openings in a valve plate 40 generally as described in my U.S. patent application Ser. No. 815,488 filed Jan. 2, 1986 now U.S. Pat. No. 4,640,674. The subject matter of that application is herein incorporated by reference. Briefly, the valve plate 40 is circular and is supported in a plane normal to the longitudinal axis X—X of the cylindrical combustion chamber 20 by a housing generally indicated at 42. The housing includes an inner part 44 that extends between plate 40 and the combustion chamber and an outer part 46 having a series of radially extending arms or spokes 48 between which air can flow into the combustion chamber when the valves 38 are open. A hub 50 at the center of the spokes 48 receives a gas inlet pipe 52 that extends between the fuel gas distributor 34 and an external gas supply (not shown).

During low pressure portions of the pulse combustion cycle, the valves 38 open to admit air into the combustion chamber from enclosure 30, and during high pressure portions of the cycle the valves close and air is no longer admitted.

The fuel gas distributor 34 is designed to form a bluff body within the combustion chamber. The term "bluff body" is used herein has its normal meaning of a body that provides a broad flattened front. Distributor 34 is in fact a hollow casting having a flat circular front face 34*a* and is coupled to and supported by the gas inlet pipe 52. The distributor has a fuel inlet 56 where it meets the pipe 52, and a plurality of radially directed outlets 58 extending around a peripheral surface of the bluff body. Thus, when the combustor is in operation, streams of gas issue radially from the outlets 58 into the combustion chamber. In this particular embodiment, the peripheral surface in which the outlets 58 are disposed is an edge surface adjacent the flat front surface 34*a* of the bluff body. However, in another embodiment, the peripheral surface could be marginal band around the outer edge of surface 34*a*.

The fuel gas distributor 34 defines an annular combustion air passageway 60 around the bluff body which communicates with the air inlet valves 38 by way of a flame trap 62 so that, during low pressure portions of the pulse combustion cycle, the valve means admit air to this air passageway 60.

FIG. 1*a* shows a segment of flame trap 62. It will be seen that the trap is made up of alternate layers of flat and corrugated sheet metal strips 62a, 62b respectively which are wound around the upstream end of the gas distributor 34 with the corrugations extending axially of the combustion chamber. Flame traps formed of sheet metal strips are generally well known in the art and the flame trap has therefore not been shown in detail. The flame trap serves as a straightener for the incoming charge of air as well as protecting the air valves from blow-back and radiated heat.

In a particular practical embodiment, the bluff body formed by the gas distributor 34 occupies approximately 50% of the cross-sectional area of the combustion chamber and the flame trap the remaining 50%.

When the pulse combustor is in operation, gas and air enter the combustion chamber during the depression part of the cycle but the flow stops when the pressure increases during combustion. The gas and air are brought in with very little turbulence. As indicated previously, there is evidence that, at least with large combustors, a striated charge having streaks of gas and air performs better than a thoroughly mixed charge in terms of providing a strong cycle and good starting.

It appears that the combustion of the charge may be similar to the burning of charges in weapons cartridges where the size and shape of the grains of explosive provide the optimum burning rate for the required pressure buildup. In the pulse combustors referred to, the size and configuration of the jets of raw gas determines the rate of burning of the charge.

To reduce the turbulence produced by the jets of gas entering the combustion chamber, the velocity of the gas is reduced at the final outlets 58 by the use of a restricting orifice positioned at the junction between the fuel distributor 34 and the gas inlet pipe 52. Orifice 64 has an open area of approximately one third of the sum of the open areas of the outlets 58.

In an actual 3.2 million BTU combustor running on propane, the central orifice was 0.375 inches diameter (area 0.110 square inches) and the outlets were 0.145 inches diameter (0.0165 square inches)×20 holes=0.330 square inches.

FIG. 1 also illustrates a second aspect of the invention designed to provide for improved feeding of material into the exhaust pipe of the combustor. Thus, as shown, the exhaust pipe 26 is cylindrical in shape and includes an inner portion 26a of a first diameter and an outer portion 26b which forms a continuation of the inner portion and which is of increased diameter. The exhaust pipe is provided with a material inlet 66 disposed in the outer portion 26b downstream of its junction with the inner portion 26a. Thus, it has been found that high velocity gases flowing from the small diameter inner portion 26a into the larger diameter outer portion 26b during high pressure portions of the pulse combustion cycle cause an injector action in the vicinity of material inlet 66 so that the material tends to be sucked into the exhaust pipe. This arrangement at least partially overcomes the tendency for a positive pressure to occur at the point of material infeed. FIG. 5 illustrates a still further improvement according to which introduction of material into the exhaust pipe or tail pipe is timed with the cycle of the pulse combustor. The particular embodiment shown in FIG. 5 is in fact a development of the embodiment shown in FIGS. 3 and 4 and will be described after FIGS. 3 and 4.

It will of course be understood that the exhaust pipe configuration that provides the injector action described is appropriate only for pulse combustors designed for dehydration, where material to be dehydrated is introduced into the exhaust pipe and subjected to the effect of heat and sound waves for dehydration. Reference is made to co-pending U.S. patent application Ser. No. 851,171 filed Apr. 4, 1986 for a more detailed description of this phenomenon.

It has been proposed in pulse combustion dehydration apparatus, to install an exhaust blower at the outlet of the material collection chamber to lower the pressure in the entire system including the point of entry of the material. However, in the interest of noise reduction, compactness and cost, it is advantageous to locate the combustion air blower in a box or cabinet which encloses the air valve of the combustor as shown in FIG. 1 (enclosure 30).

Figure 2:
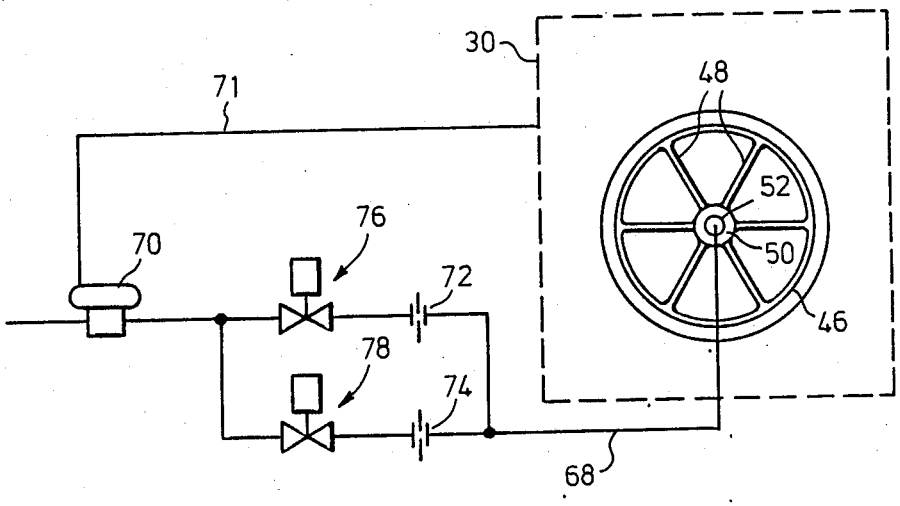
FIG. 2 is a schemmatic view of a fuel flow control system.

FIG. 2 illustrates an arrangement designed to provide for high and low firing rates of the combustor shown in FIG. 1. In FIG. 2, the combustor of FIG. 1 is shown as seen in the direction of arrow A in FIG. 1. Gas supply pipe 52 is shown entering the hub 50 in the outer housing part 46. A gas supply line connected to pipe 52 is shown schematically at 68. A gas regulator 70 sets the pressure of gas delivered from an appropriate source (not shown) in relation to the pressure inside enclosure 30. This is effected by a pressure loading line 71 from the enclosure to the housing of regulator 70. A standard main shut-off valve (not shown) is of course provided upstream of regulator 70, as required by normal safety regulations. Downstream of the regulator, respective high and low fire orifices 72 and 74 are connected in parallel and have associated therewith respective solenoid valve 76 and 78. The orifices 72 and 74 are sized in relation to the gas pressure set by regulator 70 to provide the required flow rates. The low firing rate is about one third that of the high firing rate. The gas pressure must of course be sufficient to give the required flow through the orifices against the mean combustion pressure in combustion chamber 20.

In the specific practical example given above of 3.2 million BTU combustor on propane, gas regulator 70 was set at 4.7 psi; the low fire orifice has a diameter of 11/32" and a high fire orifice had a diameter of $\frac{5}{8}$". This particular system was designed so that both orifices are used on high fire. For low fire, solenoid valve 76 will close and there will be no flow through orifice 72. This mode will be used for starting the combustor and after combustion has been satisfactorily established, solenoid valve 76 will be opened so that the combustor can operate in its high fire mode.

It should of course be understood that, even though the embodiment of FIG. 2 has been described specifically in association with the pulse combustor shown in FIG. 1, there is no limitation in this respect; the high-fire/low-fire arrangement can be used with any type of pulse combustor.

In some applications, it is desirable to modulate the fuel input according to load conditions. In this case, a variable orifice valve having suitable operating means can be used in place of the high-fire orifice 74 shown in FIG. 2. Alternatively, intermediate levels of firing can be obtaining by adding combinations of solenoid valves and orifices similar to the arrangement shown in FIG. 2.

Figure 2A:
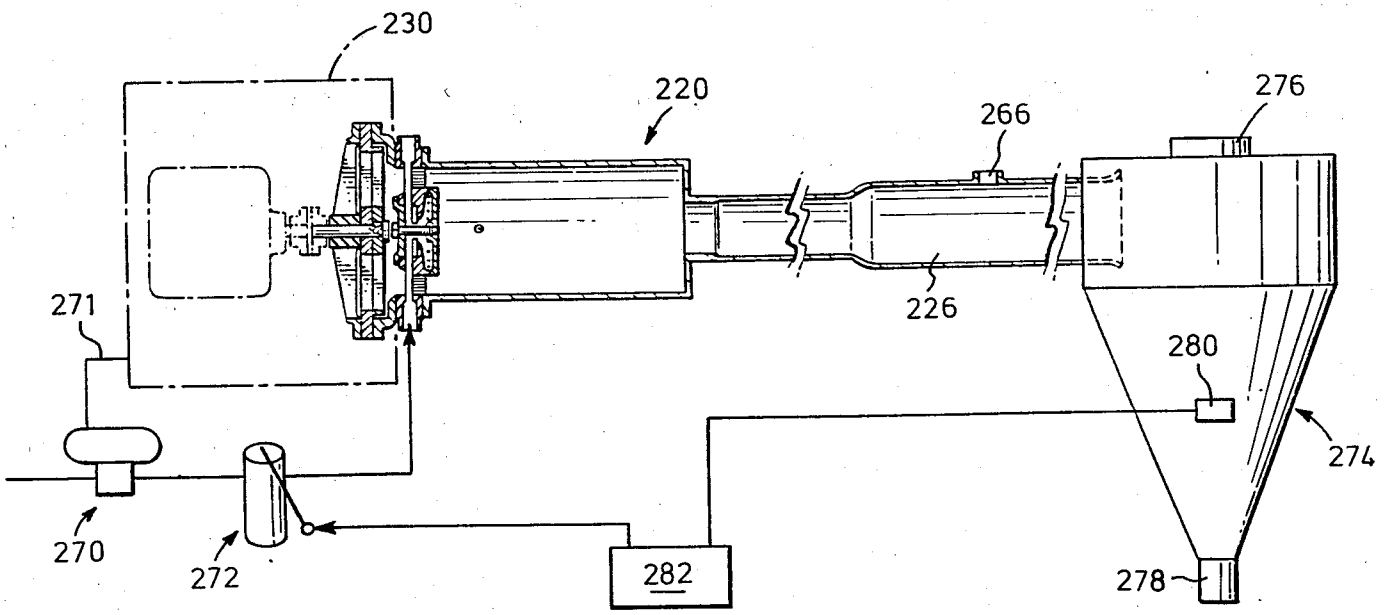
FIG. 2*a* is a schemmatic view of an alternative fuel flow control system.

FIG. 2a illustrates a further alternative in which the multiple orifices and solenoid valves of FIG. 2 are replaced by a single variable-orifice valve having a suitable operating device. Valves of this type are commercially available and are often referred to as "characterized" valves. As shown in FIG. 2a, gas from a supply (not shown) is delivered to a regulator 270 upstream of the variable orifice valve itself, which is generally denoted 272. A pressure loading line 271 extends from the regulator to an enclosure 230 for the combustion chamber 220, generally as described in connection with the preceding embodiments.

In FIG. 2*a*, the pulse combustor has been shown in longitudinal section. The particular apparatus illustrated is intended for material dehydration and has an exhaust pipe 226 provided with a material inlet 266. The exhaust pipe discharges into material collection means generally denoted 274 and in this case is shown as a cyclone separator. The cyclone separator has a gas outlet 276 and a material outlet 278. Internal details of the cyclone separator have not been shown since they may be conventional. Alternatively, reference may be made to U.S. patent application Ser. No. 851,171 filed Apr. 14, 1986 for a description of a novel form of cyclone separator that may be used. For present purposes, it is sufficient to note that material is discharged into the cyclone separator in an exhaust gas stream from the exhaust pipe 226 of the pulse combustor, and that the material is separated from the gas stream in the separator and leaves through outlet 278 while the exhaust gases leave through outlet 276.

As noted previously, the intention is that the variable orifice valve 272 will modulate the fuel input to the pulse combustor according to load conditions. In this case, the load conditions are monitored by a temperature sensor 280 responsive to the temperature within the cyclone separator. A suitable analogue control system 282 controls the valve 272 in accordance with the temperature detected by sensor 280 by appropriately operating the motor actuator (not shown) conventionally provided on a valve of this type. In principle, when sensor 280 detects that the temperature in the cyclone separator is below a predetermined threshold, the valve 272 will be automatically adjusted to increase the gas flow, which will result in an increase of the temperature within the cyclone separator.

It will of course be understood that load conditions could be monitored in other ways and in pulse combustors other than those used for dehydration. For example, in a simple embodiment, it would be possible to manually control a variable-orifice fuel supply valve in accordance with observed load conditions.

Figure 5:
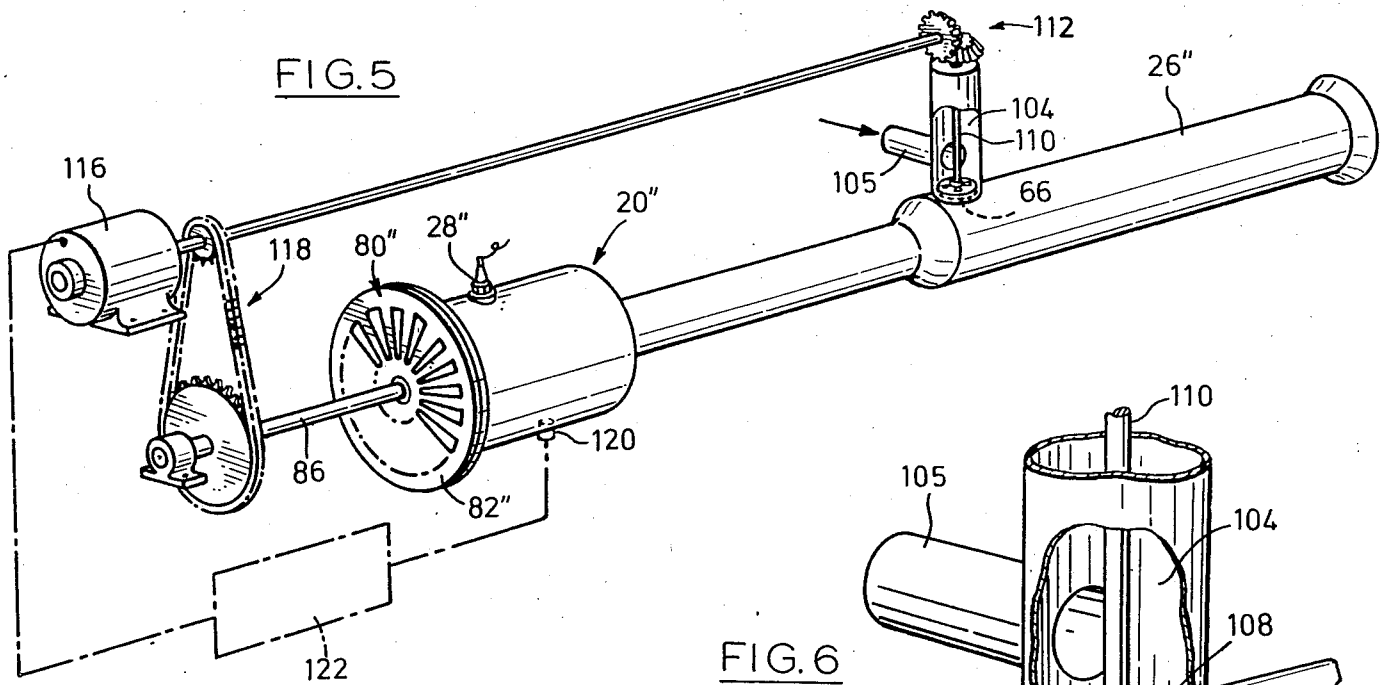
FIG. 5 is a perspective view illustrating a modification of the apparatus of FIG. 2.

Reference will now be made to FIGS. 3 and 4 in describing a further embodiment of the invention. Primed reference numerals have been used in these views to denote parts that correspond with parts shown in FIGS. 1 and 2.

The embodiment of FIG. 3 differs from the embodiment of FIG. 1 primarily in that a rotary mechanically driven air admitting valve is used in plate of the diaphragm valves 38 of the embodiment of FIG. 1. While the diaphram type of valve has been found eminently satisfactory for most applications, a rotary valve may be desirable in applications in which the valves are subject to high temperatures and pressures such as where the combustion air is reheated.

The rotary valve is visible in section in FIG. 3 and, in FIG. 4, is seen in elevation but partially broken away. The valve is generally indicated by reference numeral 80 and is made up of a stationary valve plate 82 and a rotary valve plate 84 arranged in face-to-face contact. As seen in FIG. 3, the stationary valve plate 82 is held between inner and outer housing parts 44' and 46' which are generally similar to the corresponding parts as shown in FIG. 1. The rotary valve plate 84 is disposed at the inner side of the stationary plate 82 and is carried by a shaft 86 that extends through an opening at the center of the stationary valve plate. Shaft 86 is then coupled to a variable speed drive motor indicated in dotted outline at 88.

As best seen in FIG. 4, the two plates 82 and 84 are formed with matching openings for controlling communication between an external supply of combustion air and the combustion chamber. In the particular embodiment illustrated, the openings take the form of matching radial slot shaped ports 90, 92 in the respective plates. The ports are sized to be opened 35–40% of the time when plate 84 is rotating. In operation, motor 88 drives the rotary plate 84 at a speed which allows the periods of port opening to match the operating frequency of the combustor. It follows from this that the speed of rotation will lower if the number of ports is increased. A low speed of rotation requires less power and also results in less wear on the components. Another advantage of having a large number of ports is that it improves the pattern of air distribution at the intake of the combustor.

In a simple embodiment, the variable speed motor 88 may be manually controlled. After initial setting, it is anticipated that it will be necessary merely to make minor adjustments to the motor speed to compensate for changes in the cycle due to temperature condition and material infeed. In a more sophisticated arrangement (see later) the motor speed may be automatically controlled.

The pulse combustor shown in FIG. 3 includes a bluff body fuel distributor 34' which is essentially similar to the distributor shown in FIG. 1 except in that gas is fed radially inwardly to the distributor through a series of radial inlet passageways two of which are shown at 94. This arrangement ensures good uniformity of distribution in the gas delivered to the distributor. The two passageways 94 communicate with an annular boss 96 centered on the longitudinal axis of the combustion chamber. Boss 96 is clamped to the fuel distributor 34' by a bolt 98. The boss 96 is hollow and provides a restricted annular opening 100 between the fuel inlet passageways 94 and the interior of the fuel distributor 34'. This opening acts in the same fashion as the restricted opening 64 in the embodiment of FIG. 1.

Figure 6:
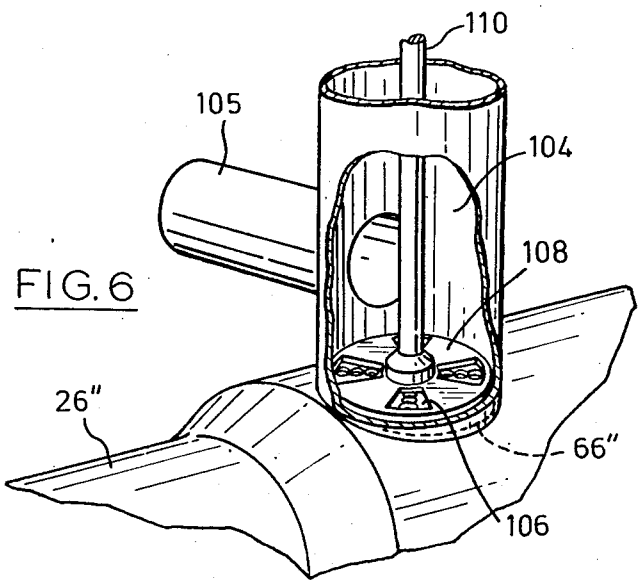
FIG. 6 is an enlarged detail view of part of FIG. 5.

Reference will now be made to FIGS. 5 and 6 in describing a further aspect of the invention relating specifically to dehydration. FIG. 5 shows a pulse combustion apparatus that may be considered as a modification of the apparatus shown in FIGS. 3 and 4. Accordingly, double-primed reference numerals have been used in FIG. 5 to denote parts that correspond with parts shown in FIGS. 3 and 4.

The apparatus of FIG. 5 includes a combustion chamber 20'' having a tail pipe 26'' and an air admitting valve 80'', all of which are essentially the same as described in connection with FIGS. 3 and 4. The rotary valve plate (not shown) of valve 80'' is driven from a drive motor 88'' by a shaft 86''. A material inlet opening 66'' is provided in an enlarged outer portion of the combustor tail pipe 26''. The apparatus of FIGS. 5 and 6 differs from the preceding embodiment primarily in that it includes an arrangement for delivering material to be dehydrated to the inlet 66'' in timed relation with the pulse combustion cycle. Thus, it is believed that it may be advantageous in effect to inject material to be dehydrated just slightly in advance of the pressure wave that travels down the tail pipe so that the material would in effect be carried down the tail pipe by the pressure wave. On the other hand, with some materials it might be desirable to inject the material when the exhaust gases are flowing in the opposite direction (towards the combustion chamber) in order to increase the time of suspension of the material. It is believed that timing of injection of the material may be particularly advantageous where materials in liquid- or slurry-form are to be dehydrated. For other materials, deliverying the material directly into the tail pipe on a continuous or intermittent basis, may be sufficient.

Referring now specifically to FIGS. 5 and 6, a material inlet valve assembly is generally indicated by reference numeral 102 and includes a cylindrical chamber 104 extending upwardly from the material inlet 66″ and having extending laterally therefrom a tubular material inlet port 105. Port 106 simply opens directly into chamber 104 as best seen in FIG. 6. Within chamber 104 is a rotary valve formed by a stationary valve plate 106 (FIG. 6) that extends across opening 66″, and a stationary valve plate 108 disposed on top of plate 106. Rotary plate 108 is carried at the lower end of a shaft 110 that is driven in rotation by bevel gears 112 from a horizontal drive shaft 114. Shaft 114 is in turn driven by a variable speed electric motor 116 that also drives the rotary valve plate of the air admitting valve 80″ by way of a roller chain drive generally indicated at 118. Motor 116 replaces the drive motor 88 for the air admitting valve that appears in the preceding embodiment, so that motor 116 drives both the rotary air admitting valve 80″ and the material injection valve, in synchronism. Again, the speed of motor 116 may be manually set. Alternatively, the motor may be driven under electronic control as indicated in ghost outline by using a pressure transducer 120 in the combustion chamber to produce an electronic pulse at each cycle which is used to control the motor speed by way of suitable electronic circuitry indicated at 122.

The space above the valve plates within chamber 104 provides an air cushion chamber for the incoming material and allows material to accumulate in that chamber before being drawing into the tail pipe of the combustor. For very liquid materials, the stationary plate 106 (FIG. 6) under the rotary valve plate 108 will be perforated to break up the flow of material into small jets or a spray. With coarser liquid material (e.g. sewage sludge) the openings would be as large as possible.

It will of course be appreciated that the described arrangement for injection of material to be dehydrated is not limited in its application to pulse combustors having a mechanically driven air admitting valve. Injection of material could be timed directly from the pulses in the combustion chamber generally as described previously by using a pressure transducer or other means to sense the pulses. It would even be possible to positively force the material into the tail pipe using some form of direct displacement injection system such as a piston. However, piston injection probably would not be satisfactory for some materials (e.g. viscous materials). For example, with the 3.2 million BTU combustor described previously approximately $\frac{3}{4}$ of a cubic inch of material will be admitted at each cycle and at 60 cycles per second. Piston injection would probably not work with viscous materials at these rates. In the described embodiment, the rotary admitting valve shown with four ports would rotate at 900 rpm and the air admitting valve 80″ with 18 ports would run at 200 rpm.

Figure 7:
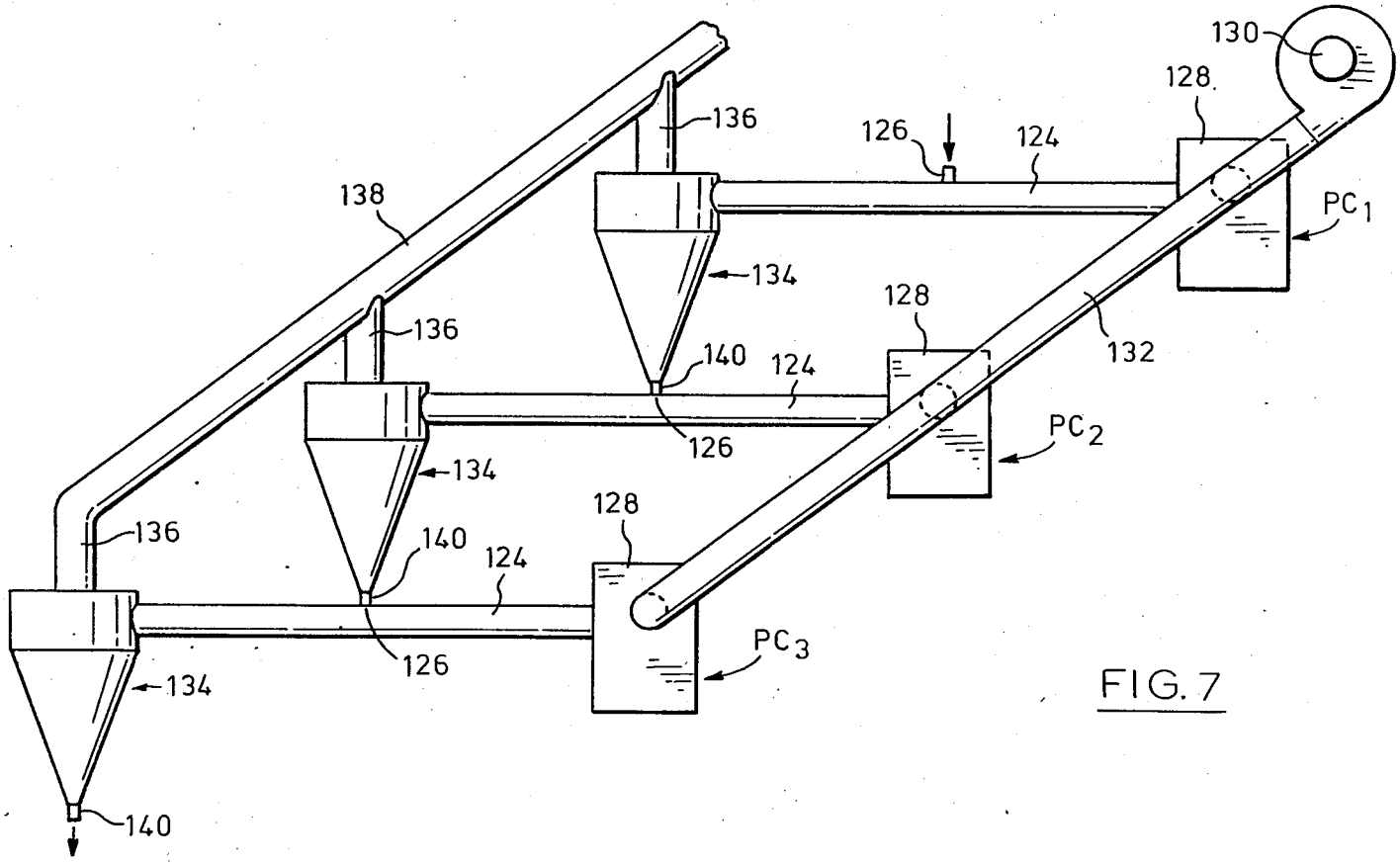
FIG. 7 is a schematic illustration of a pulse combustion dehydration apparatus; and, FIG. 8 is a somewhat schemmatic vertical sectional view through one of the combustors of FIG. 7.
Figure 8:
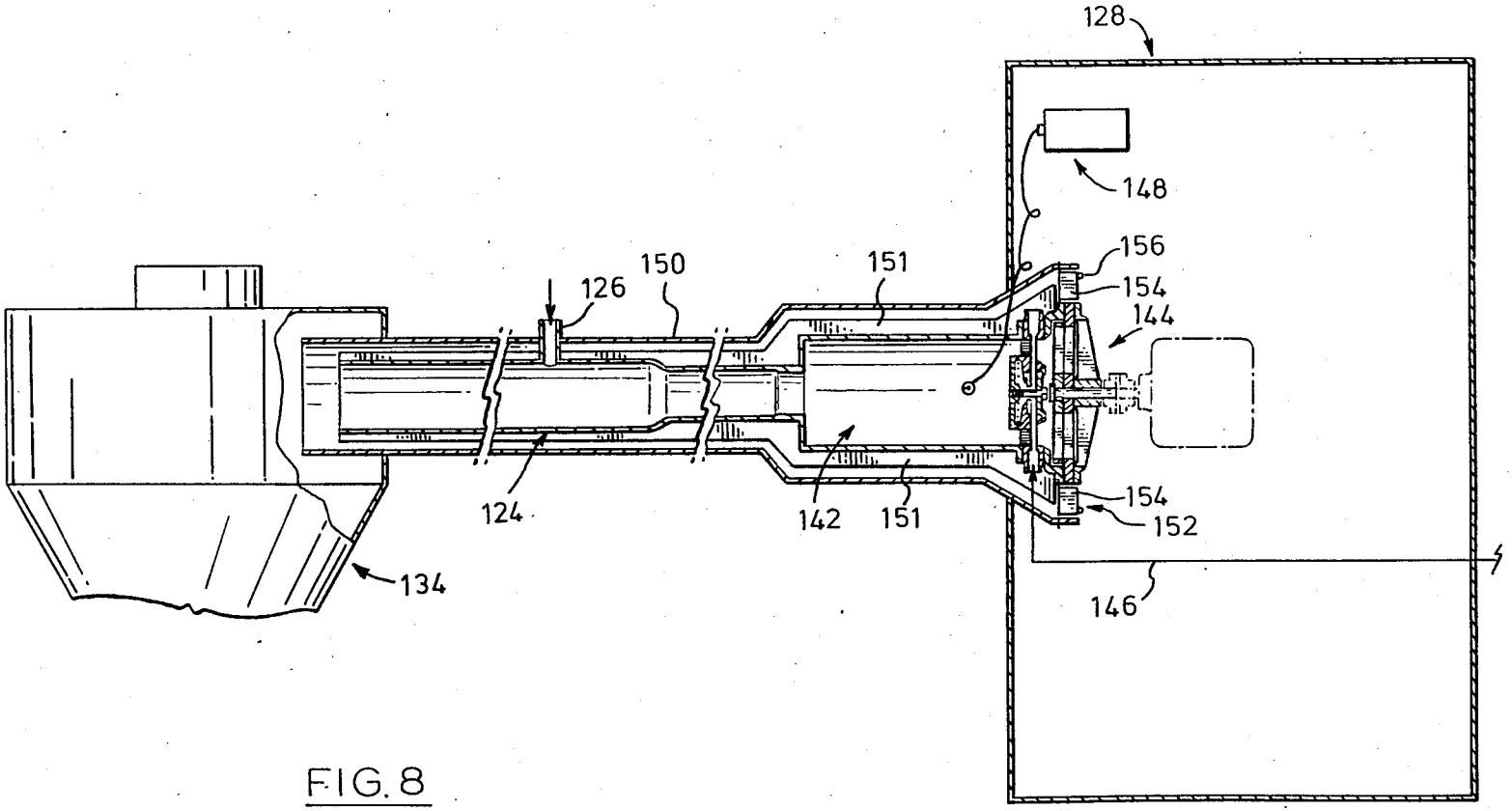

In dehydrating certain materials, for example those that may be adversely affected by excess heat, it may be desirable to extend the length of time for which the material is subjected to the effect of the high temperature pulsating gases of the pulse combustor. An example of a material for which it is believed that this may be advantageous is fructose. FIGS. 7 and 8 illustrate a pulse combustion dehydration apparatus designed to achieve this end. As shown in FIG. 7, a series of three pulse combustors and associated cyclone separators are disposed in a cascade arrangement so that the material is successively processed in three stages. The three pulse combustors are individually denoted $PC_1$, $PC_2$ and $PC_3$ and are essentially identical. For simplicity of illustration, only the exhaust pipe of each combustor is shown; the exhaust pipes are individually denoted 124 and each has a material inlet 126. The combustion chambers themselves have not been shown but are disposed within housings 128 similar to the housing 30 shown in FIG. 1. A common blower 130 supplies air to all three housings through a duct 132. Each exhaust pipe 124 discharges into a cyclone separator 134 which may be of conventional form or of the form described in U.S. patent application Ser. No. 851,171 referred to previously. The cyclone separators have respective exhaust gas outlets 136 connected to a common exhaust duct 138. The separators also have respective outlets 140 for the material that has been dehydrated.

As can readily been seen from FIG. 7, the material outlet 140 of the first pulse combustor $PC_1$ in the series is connected to the material inlet 126 of the exhaust pipe 124 of the second pulse combustor $PC_2$ and the material outlet of the cyclone separator for that combustor is connected to the material inlet for combustor $PC_3$. In this way, material delivered into the inlet of the pulse combustor $PC_1$ is subjected to successive dehydration processing in each of three stages. The material is in effect subjected to the effect of the pulsating exhaust gases for three times as long as would otherwise be the case. Of course, the number of stages can be varied from a minimum of two as many as is considered appropriate although it is believed that three will probably be the maximum number required for most materials.

To prevent overheating of the material (which can lead to various undesirable effects such as scorching) it may be desirable to regulate the pulse combustors to reduce the heat in at least the last stage. FIG. 8 illustrates one method in which this may be achieved. In this case, secondary air is directed over the external surface of the pulse combustor for cooling and provision is made to vary the volume of secondary air flowing over the combustor so that some combustors can be cooled to a greater extent than others. The use of secondary air in this way is disclosed in U.S. patent application Ser. No. 851,171 referred to previously and the disclosure of which is incorporated herein by reference. However, for the sake of completeness, FIG. 8 has been included to show how the secondary air flow is achieved.

Referred now to that view, one of the pulse combustors (say combustor $PC_1$) is shown although its proportions are somewhat different from those of the combustors shown in FIG. 7. As shown in FIG. 8, the exhaust pipe 124 of the combustor extends between enclosure 128 and the cyclone separator 134. Within housing 128 is a combustion chamber 142 having a rotary air admitting valve generally indicated at 144, gas supply means 146 and a spark plug and associated electrical equipment generally indicated at 148. Surrounding the exhaust pipe 124 and combustion chamber 142 is a shroud 150 that provides a passageway for combustion air around the combustion chamber and exhaust pipe. Both the combustion chamber and the exhaust pipe have axial heat radiating fins 151 within shroud 150. The shroud is open at both ends so that air can enter from the interior of enclosure 128 (from duct 132—FIG. 7) and can exit into the cyclone separator. Air enters the shroud through an annular space generally indicated at 152 between the shroud and the air admitting valve 144. An annular series of flaps or shutters, two of which are visible at 154, are provided in this space and are pivoted about axes extending radially with respect to the longitudinal axis of the combustion chamber. Thus, by appropriately turning these flaps, the volume of air entering the shroud can be controlled. The flaps are interconnected by an annular ring 156 so that the can all be turned simultaneously and an appropriate adjustment mechanism is provided for incrementally adjusting the position of the ring and hence the positions of the flaps. This arrangement is described in detail in U.S. patent application Ser. No. 851,171.

It will of course be understood that, by differently setting the flaps for the three pulse combustors shown in FIG. 7, different volumes of secondary air can be permitting to flow so that the respective combustors can be cooled to different extents.

In conclusion, it should be noted that the preceding description relates to particular preferred embodiments of the invention only and that many modifications are possible within the broad scope of the invention. For example, the bluff body fuel gas distributor can be used in other types of pulsating combustor and is not limited to use with cylindrical combustion chambers or with pulse combustors for dehydration. This also applies to the high-fire/low-fire fuel supply arrangement of FIG. 2 and to the rotary air admitting valve of FIGS. 3 and 4. The arrangement of FIG. 2 may of course be applied to the embodiment of FIGS. 3 and 4.

The combustors shown in the drawings are designed to use gas as a fuel. Except for the embodiments that use a gas distributor, the combustors may be designed to run on other fuels.

I claim:

1. A pulse combustion apparatus comprising:

a combustion chamber having inlet means for fuel charges and an outlet for exhaust gases remote from the inlet means;

an exhaust pipe extending from said exhaust gas outlet and forming a resonant system with the combustion chamber; and, means operable to initiate combustion in said chamber;

wherein said fuel charge inlet means comprises:

a fuel gas distributor forming a bluff body within the combustion chamber and defining an annular combustion air passageway around the body, the distributor having a fuel inlet for connection to a fuel supply externally of the combustion chamber, and a plurality of discrete fuel gas outlets extending around a peripheral surface of the bluff body and from which individual gas streams issue when the apparatus is in operation; and, valve means for admitting air to said air passageway during low pressure portions of the pulse combustion cycle;

whereby, at each cycle, a striated charge having streaks of gas and air is introduced into the combustion chamber.

2. An apparatus as claimed in claim 1, wherein said combustion chamber is of generally cylindrical shape with said fuel gas distributor disposed generally centrally of one end of the combustion chamber, so that said annular combustion air passageway is defined between the distributor and a cylindrical wall of the combustion chamber, and wherein an annular flame trap extends across said passageway upstream of the fuel gas outlets of the distributor, the flame trap acting as a straightener for the incoming charge of air at each pulse combustion cycle.

3. An apparatus as claimed in claim 2, wherein the bluff body and flame trap each occupy approximately 50% of the total cross-sectional area of the combustion chamber at the position of the gas distributor.

4. An apparatus as claimed in claim 1, wherein said combustion chamber is cylindrical and the fuel gas distributor is disposed at an end of the chamber generally on a longitudinal axis thereof and wherein the fuel gas outlets extend radially outwardly with respect to said axis.

5. An apparatus as claimed in claim 1, wherein said gas distributor includes restriction means upstream of said fuel gas outlets for reducing the velocity of the gas at said outlets and thereby reducing the turbulence produced by jets of gas entering the combustion chamber when the apparatus is in operation.

6. An apparatus as claimed in claim 5, wherein said restriction means comprises an orifice having an open area equal to approximately one third of the total areas of said fuel gas outlets.

7. A pulse combustion dehydration apparatus comprising:

a combustion chamber having inlet means for fuel charges and an outlet for exhaust gases remote from the inlet means;

an exhaust pipe extending from said exhaust gas outlet and forming a resonant system with the combustion chamber; and, means operable to initiate combustion in said chamber;

wherein said exhaust pipe includes an inner portion adjacent said combustion chamber of a first diameter and an outer portion adjacent said inner portion of increased diameter, and wherein the exhaust pipe is provided in said outer portion with an inlet for material to be dehydrated arranged so that gases flowing from said inner portion to said outer portion cause an injector action at said material inlet.

8. An apparatus as claimed in claim 7 further comprising a material inlet valve associated with said material inlet and means for opening and closing said valve in timed relation to the pulsating combustion cycle of the apparatus.

9. An apparatus as claimed in claim 8, wherein said inlet valve comprises first and second valve plates arranged in face-to-face contact, said first plate being arranged in a stationary position extending across said material inlet and said second plate being rotatable with respect to the first plate, the plate being provided with co-operating openings for permitting entry of material through said inlet when the openings are in co-operating relationship, said means for opening and closing the valve comprising a drive motor coupled to said rotary plate.

10. An apparatus as claimed in claim 9, wherein said fuel charge inlet means of the pulse combustion apparatus includes a rotary air admitting valve controlling communication between said combustion chamber and a combustion air supply, and drive means for rotating said valve at a speed appropriate to the pulsating combustion cycle of the apparatus, said drive means being coupled to said rotary plate of the material inlet valve for operating the valve in synchronism with the rotary air admitting valve.

11. An apparatus as claimed in claim 9, further comprising an air cushion chamber extending outwardly from said material inlet and enclosing said valve plates, and a material inlet port communicating with said chamber so that material to be dehydrated is delivered into said chamber before passing through said valve.

12. A pulse combustion apparatus comprising:

a combustion chamber having inlet means for fuel charges and an outlet for exhaust gases remote from the inlet means;

an exhaust pipe extending from said exhaust gas outlet and forming a resonant system with the combustion chamber; and, means operable to initiate combustion in said chamber;

wherein said fuel charge inlet means comprises means for delivering fuel to said combustion chamber and a rotary air admitting valve controlling communication between said combustion chamber and a combustion air supply, said valve comprising first and second plates mounted in face-to-face contact, a first one of said plates being fixed and a second one of said plates being rotatable with respect to the fixed plates, the plates being formed with co-operating opening for controlling communication between said combustion air supply and said combustion chamber, and drive means for rotating said second plate at a speed appropriate to the pulsating combustion cycle of the apparatus.

13. An apparatus as claimed in claim 12, wherein said co-operating openings in the valve plates comprise radial slot-shaped ports in the respective plates.

14. An apparatus as claimed in claim 12, wherein said co-operating openings are shaped to provide for air flow through the valve for between 35 and 40% of the time during which the rotary plate is turning.

15. A pulse combustion apparatus comprising:

a combustion chamber having inlet means for fuel charges and an outlet for exhaust gases remote from the inlet means;

an exhaust pipe extending from said exhaust gas outlet and forming a resonant system with the combustion chamber;

means operable to initiate combustion in said chamber; and, fuel supply means connected to said combustion chamber inlet means and including means operable to restrict fuel flow to said inlet means for providing a low fire operating mode for starting of the apparatus and a high fire normal operating mode.

16. An apparatus as claimed in claim 15, wherein said fuel supply means comprises first and second flow restricting orifices connected in parallel in a fuel supply line to said combustion chamber inlet means, and valve means associated with said orifices and operable to prevent flow through at least one of the orifices and provide said low-fire operating mode for the apparatus.

17. An apparatus as claimed in claim 16, wherein said valve mans comprises a solenoid valve associated with each of said first and second orifices, said orifices being sized so that fuel flows through both orifices in the high fire mode and through only one of the orifices in the low fire mode.

18. A pulse combustion apparatus comprising:

a combustion chamber having a fuel gas inlet, valve means for admitting air to said combustion chamber during low pressure portions of the pulse combustion cycle and an outlet for exhaust gases remote from the inlet means;

an exhaust pipe extending from said exhaust gas outlet and forming a resonant system with the combustion chamber;

means operable to initiate combustion in said chamber; and, fuel supply means connected to said fuel gas inlet and including a gas supply line and means remote from said combustion chamber operable to modulate fuel flow to said fuel gas inlet according to load conditions.

19. An apparatus as claimed in claim 18 for dehydration of material, wherein said exhaust pipe includes a material inlet, and wherein the apparatus further includes; material collection means having an inlet through which said exhaust pipe extends, a gas outlet and a material outlet; a temperature sensor in said material collection means; and control means connected between said sensor and said fuel flow modulation means and adapted of control said flow modulation means of modulate fuel flow according to the temperature detected by said sensor.

20. Pulse combustion dehydration apparatus comprising a series of at least two pulse combustors each having a combustion chamber with inlet means for fuel charges and an outlet for exhaust gases remote from the inlet means, an exhaust pipe extending from said gas outlet and forming a resonant system with the combustion chamber, the exhaust pipe including an inlet for material to be dehydrated, and means operable to initiate combustion in said chamber, each said combustor having associated therewith material collection means having an inlet receiving the exhaust pipe of the combustor, a gas outlet and a gas outlet for material that has been dehydrated;

said combustors being disposed in a cascade arrangement with the outlet of the material collection means of a first one of said combustors communicating with the material inlet of the exhaust pipe of a second said combustor, whereby the material is subjected to successive dehydration processing in each of said combustors.

21. An apparatus as claimed in claim 20, wherein each said combustor includes means for directing secondary air externally of the combustion chamber for cooling, and means for controlling the volume of said air, the apparatus further including common air supply means for delivering combustion air and secondary air to all of the combustors in said series, said control means of the respective combustors being arranged to permit differential cooling of the combustors in the series to prevent overheating of material being dehydrated.

22. A pulse combustion apparatus comprising:

a combustion chamber having inlet means for fuel charges and an outlet for exhaust gases remote from the inlet means;

an exhaust pipe extending from said exhaust gas outlet and forming a resonant system with the combustion chamber, the exhaust pipe including a material inlet;

means operable to initiate combustion in said chamber;

fuel supply means connected to said combustion chamber inlet means and including means operable to modulate fuel flow to said inlet means according to load conditions;

material collection means having an inlet through which said exhaust pipe extends, a gas outlet and a material inlet;

a temperature sensor in said material collection means; and, control means connected between said sensor and said fuel flow modulation means and adapted to control said flow modulation means to modulate fuel flow according to the temperature detected by said sensor.

* * * * *